US005966962A

United States Patent [19]

Murray et al.

[11] Patent Number: 5,966,962

[45] Date of Patent: Oct. 19, 1999

[54] MODULAR HYDRATION AND FREEZING PLANT FOR FLEXIBLE REFRIGERANT MEDIA

[75] Inventors: Joseph C. Murray; Lyman Ernest Don Gaude, both of Mobile, Ala.

[73] Assignee: Thermal Products, Inc., Northridge, Calif.

[21] Appl. No.: 09/075,429

[22] Filed: May 8, 1998

[51] Int. Cl.[6] ..... F25D 17/02

[52] U.S. Cl. ..... 62/374; 62/380; 62/530

[58] Field of Search ..... 62/63, 65, 374, 62/380, 530

[56] References Cited

U.S. PATENT DOCUMENTS 5,460,015 10/1995 Venetucci ..... 62/63

5,860,282 1/1999 Liberman et al. ..... 62/530

*Primary Examiner*—Ronald Capossela

*Attorney, Agent, or Firm*—Robert J. Veal; Veal & Bush, LLC

[57] ABSTRACT

Apparatus for preparing packaging materials for use in shipment of heat sensitive materials, utilizes a hydration module, a freezing module, and a delivery module. Rolls of superabsorbent polymer based refrigerant media in the form of a continuous web of a selected length and width are maintained in dry storage. These may be cut to size along the web material which separates cells containing the super absorbent polymer or may be precut by the manufacturer into pads of desired sizes. The web or pad is advanced into the hydration module which comprises a dip tank or spray system to provide an adequate supply of hydrating fluid to the superabsorbent polymer. The absorbed fluid fills the cells of the web. The hydrated web is then conveyed into a freezing chamber having a temperature of −10 degrees Fahrenheit, or lower, where the fluid absorbed within the cells freezes. The frozen material then exits the freezing chamber. The small footprint of the modular system means that necessary handling, including cutting into a suitable size and shape, may be accomplished in the consumer's shipping area for placement around perishable materials in shipping containers.

21 Claims, 4 Drawing Sheets

MODULAR HYDRATION AND FREEZING PLANT FOR FLEXIBLE REFRIGERANT MEDIA

FIELD OF THE INVENTION

The present invention relates generally to apparatuses and processes for hydrating and freezing a selected media used to keep a variety of objects cold. In greater particularity, the current apparatus and method relates to apparatuses and processes for hydrating and freezing refrigerant media containing superabsorbent polymer laminated in individual cells on continuous sheets of thermoformable media which may be placed into shipping cartons so that a selected cool temperature may be maintained within the carton during shipment to a selected destination.

BACKGROUND OF THE INVENTION

The present invention is an apparatus and method for hydrating and freezing superabsorbent polymer based refrigerant media similar to that disclosed in international patent application number PCT/US92/06486 (in reference to U.S. App. Ser. No. 07/738835), herein incorporated for reference, or similar media which is used to keep perishable materials at a controlled, cool or freezer temperature during shipment. Accordingly, discussion of the structure and properties of the media disclosed in the referenced patent shall be discussed in detail only to the extent necessary to explain the media's interaction with the components of the apparatus and method herein described, and inasmuch as a detailed understanding of the chemical properties of the media are not necessary for an understanding of the invention.

Prior to using superabsorbent polymers laminated into individual cells, shipping containers utilized only a few substances to maintain a cool temperature inside a shipping container. These include: ice in sealed pouches, dry ice, and gel blocks. However, for reasons such as high cost, contamination and handling problems, and an inability to maintain critical temperatures in a container during shipment, these shipping materials have begun to be replaced with frozen, superabsorbent polymer based refrigerant media [hereinafter media]. One such media is ThermaFreeze® made by Thermafreeze, Inc. of Mobile, Ala. ThermaFreeze® is manufactured in long rolls, typically in 15 or 30 inch widths, containing a matrix of laminated individual cells between elongated continuous sheets of thermoformable media, as disclosed in the referenced patent. Each cell contains a measured amount of superabsorbent polymer capable of absorbing water to many times its own weight and size, thereby filling each cell upon exposure to water. Prior to exposure of the cells to an aqueous environment, the cells in the rolls are filled with the superabsorbent polymer powder which occupies negligible space inside the cells. Therefore, prior to hydration the cells are un-expanded and the media consists of a flat sheet or web of cells typically 15 or 30 inches wide and of a preselected length (typically 300 feet).

In one preferred operation, a media roll must be unwound, exposed to an aqueous environment suitable to quickly hydrate the media, frozen, and cut into shapes and sizes suitable for arrangement within shipping containers. This preparation operation may be established "on-site" within a production facility for a user consuming the media in shipping operations. However, current methods for preparing the media are manually based and, therefore, time consuming; thereby increasing the overall cost of utilizing the media in shipping operations. Furthermore, the consumer may not have the necessary know how to optimize the preparation operation so that the media is suitably prepared for incorporation within shipping containers of varying sizes and shapes. In addition, a variety of other uses may be made of the product, but for the lack of proper knowledge and a feasible automation facility.

Therefore, there is a need in the shipping packaging, and other industries for an apparatus and method for automating the preparation of superabsorbent polymer refrigerant media prior to arrangement into shipping containers. Inasmuch as many facilities place a premium on the use of floor space, a modular unit which has a relatively small "footprint" is important.

SUMMARY OF THE INVENTION

It is the object of the present invention to provide an apparatus for automating the hydration and freezing of superabsorbent polymer based refrigerant media.

A further object of the present invention is to provide a method for optimizing the hydrating and freezing of superabsorbent polymer based refrigerant media.

Yet another object of the present invention is to provide a modular minimal footprint plant incorporating a method for hydrating and freezing superabsorbent polymer based refrigerant media so that the media may be suitably prepared at a consumer's site prior to arrangement into shipping carriers.

The invention includes a hydration module, a freezing module, and a delivery module. Superabsorbent polymer based refrigerant media, in rolls or in the form of integral pads of a selected length and width are maintained in dry storage. Rolls may be cut to size along the web material which separates cells containing the super absorbent polymer or may be precut by the manufacturer into pads of desired sizes. When ready for consumption, the stored rolls may be precut at the manufacturer's or customer's site to desired lengths or may be positioned on a delivery spindle from which the web may be spooled. The web or pad is advanced into the hydration module which comprises a dip tank or spray system to provide an adequate supply of water to the superabsorbent polymer. The absorbed water fills the cells of the web. The hydrated web or pad is then is then passed to a shaker conveyor for removal of external moisture. It is then conveyed into a freezing chamber having a temperature of −10° Fahrenheit, or lower, where the water absorbed within the cells freezes. The frozen web then exits the freezer. Necessary handling including cutting into a suitable size and shape may be accomplished in the consumer's shipping area for placement around perishable materials in shipping containers. When properly arranged with the perishable materials, such as food stuff, medical or chemical products, etc. the frozen media maintains a temperature within a predetermined temperature regime in the container during transport to a shipping destination.

Other features and objects and advantages of the present invention will become apparent from a reading of the following description as well as a study of the appended drawings.

BRIEF DESCRIPTION OF THE DRAWINGS

Apparatus embodying features of the invention are depicted in the accompanying drawings which form a portion of this disclosure and wherein.

DESCRIPTION OF THE PREFERRED EMBODIMENTS

Figure 1:
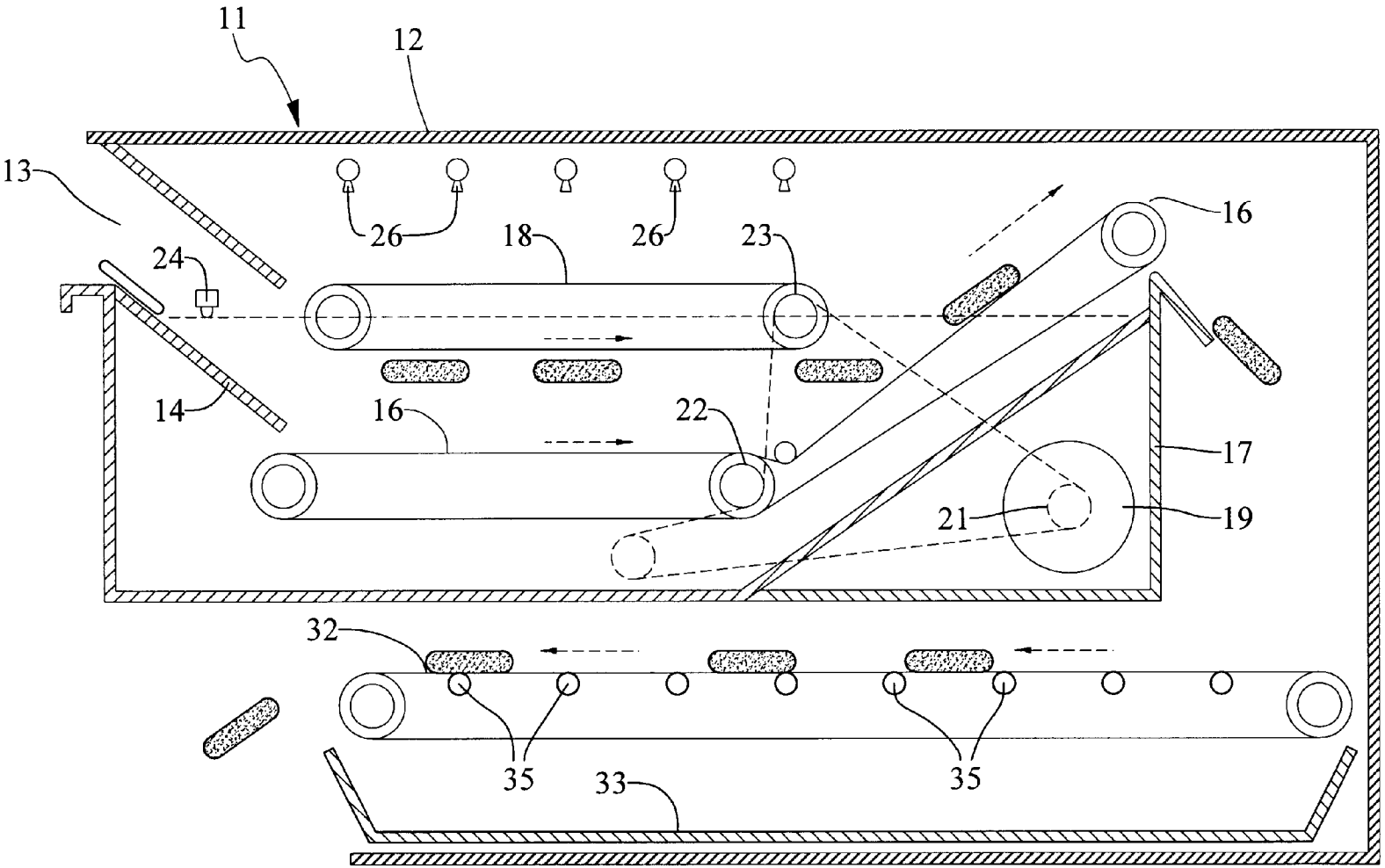
FIG. 1 is a sectional view of the hydration module taken along the longitudinal centerline thereof.
Figure 2:
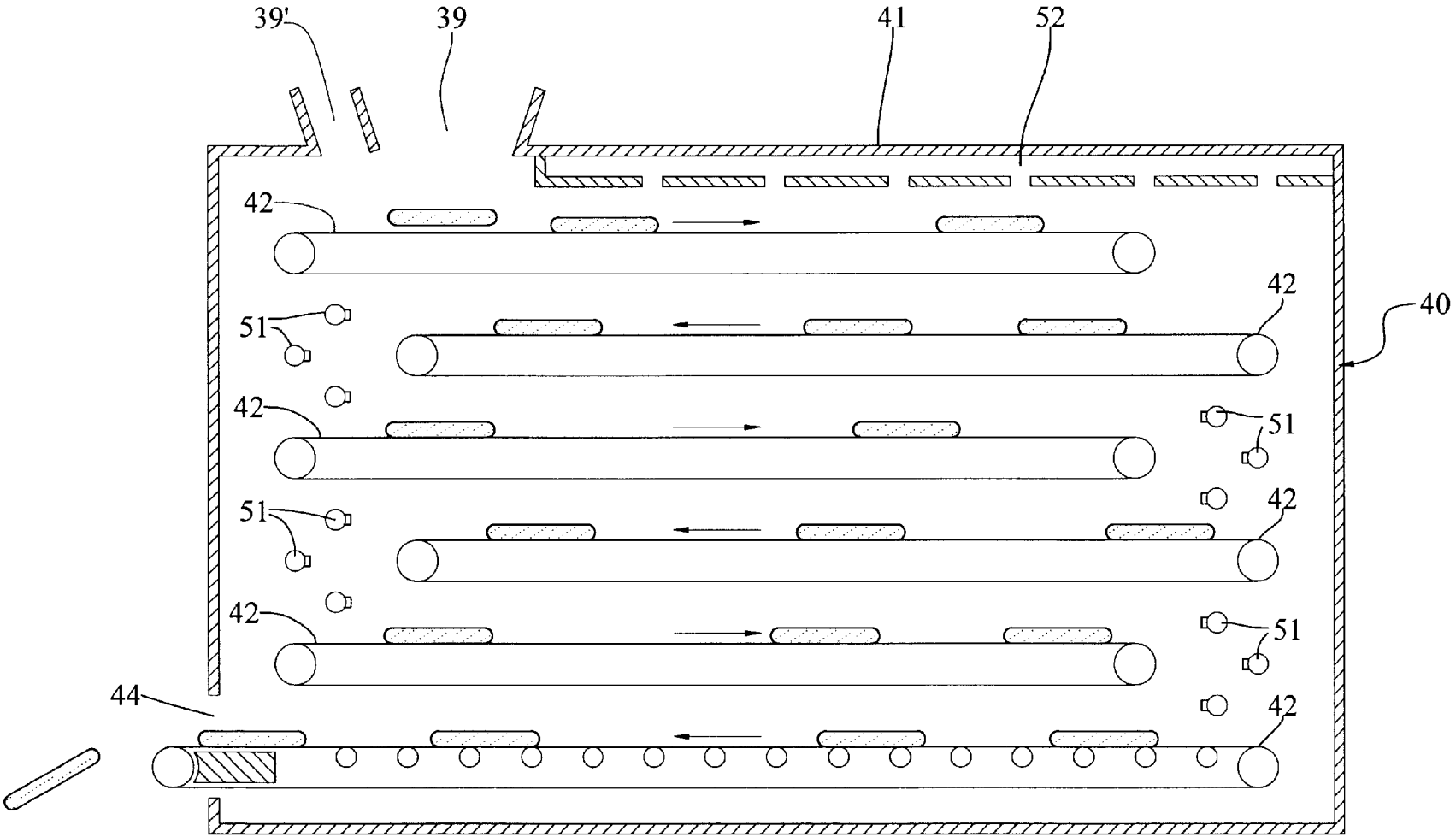
FIG. 2 is a sectional view of the refrigerant module taken along the longitudinal centerline thereof.

Referring to the figures for a clearer understanding of the invention, it may be seen in FIG. 1 that the first module 11 is a hydration unit which may be used as a stand alone unit but is specifically designed for use as a module of the media preparation apparatus. Module 11 includes an external housing 12 having an entrance opening 13 through which pads or an uncut web may be fed along a slide 14. At the bottom of slide 14 is a conveyor 16 which runs longitudinally along the bottom of a tank 17. Conveyor 16 has an inclined portion which extends upwardly and over one wall of tank 17 serving as a discharge conveyor. Optionally, a secondary conveyor 18 may be mounted above conveyor 16 at a height within tank 17. A motor 19, which may be hydraulic or electric with appropriate speed controls is mounted to a support frame within housing 12 and has an output sheaf or sprocket 21 which is connected to a drive roller 22 on conveyor 16 and a drive roller 23 on conveyor 18 by an appropriate belt or chain.

Tank 17 serves as a basin for the accumulation of a hydrating fluid. As will be understood the media is a multicell layer having a superabsorbent polymer in each cell in sufficient quantity to absorb a fluid for later freezing. The preferred fluid is water which has been filtered to remove impurities; however, other fluids may be appropriate for certain uses with specific polymers. The hydrating fluid may be filled to a certain level as shown in FIG. 1 such that conveyor 18 submerges the media beneath the surface of the fluid and urges the media toward the discharge end of conveyor 16. In this instance the fluid level is monitored by a sensor 24 and additional hydrating fluid is introduced to the tank to replenish that which hydrates the superabsorbent polymer. For example, a small unit of this design may consume about ten gallons per hour of hydrating fluid. Alternatively, a series of spray nozzles 26 may be mounted above tank 17 and media carried by conveyor 16 may be sprayed with fluid, the excess fluid being accumulated and resprayed by appropriate tubing and pump mechanisms. In either event, the conveyor is a stainless steel mesh or plastic type conveyor which allows fluid to pass therethrough yet is capable of urging the media through tank 17. The hydrating fluid may require heating to about 100 degrees Fahrenheit; thus, an external reservoir 31 of pre-heated may be employed as the source for make up fluid. The speed of the conveyors may be adjusted with conventional controls for motor 19 to ensure that the media is fully hydrated before it is removed from tank 17 on conveyor 16.

Figure 3:
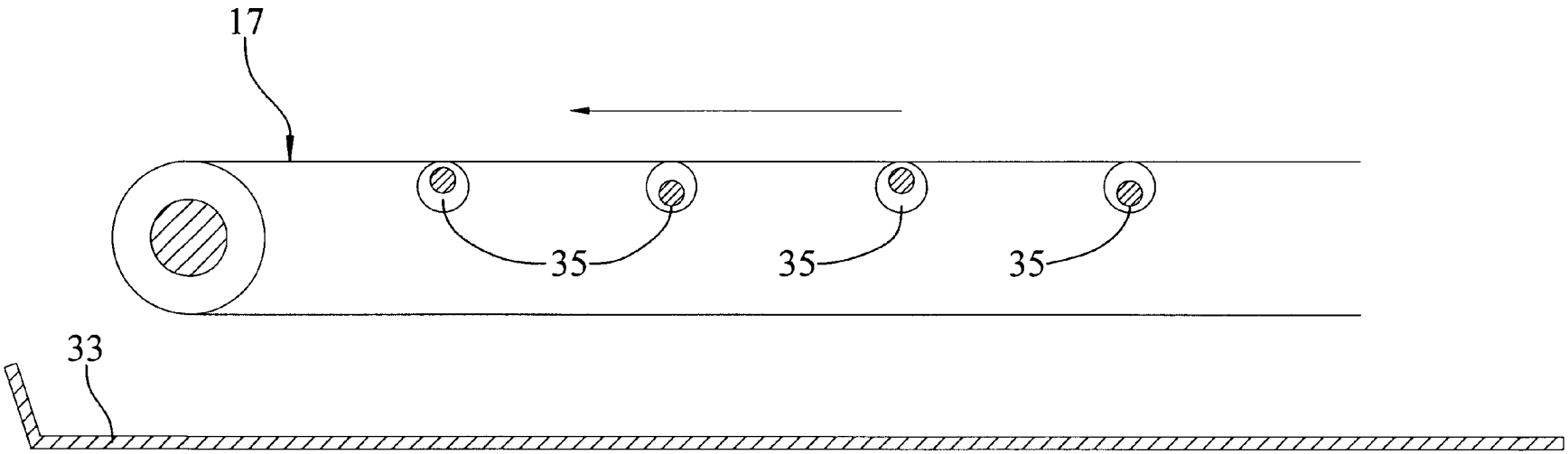
FIG. 3. is a sectional view of the shaker module taken along the longitudinal centerline thereof; and, FIG. 4 is a block diagram of the components in operative relation.

Upon exiting tank 17 the media is delivered to a drip conveyor 32 which is also a stainless steel open belt, mounted above a drip pan 33 and having a vibratory assembly associated therewith such that external surface moisture is removed from the media as it traverses the conveyor. The conveyor may be driven from a sprocket on motor 19 such that its speed is concomitant with conveyors 16 and 18. By way of example a plurality of eccentric rollers 35 as shown in FIG. 3 may be used to impart motion to the conveyor transverse to the direction of travel to assist in removing external moisture. Excess fluid may also be removed from the media by employing a high pressure air knife.

Drip conveyor 32 terminates at an entrance 39 into a refrigerant module 40. Module 40 includes an insulated housing 41 within which a plurality of successive conveyors 42 are supported for concomitant motion, each being similar in nature to the conveyors used in the first module 11. Hydrated media moves successively from one conveyor to another until discharged from outlet 44. The interior of housing 41 is maintained at a temperature well below the freezing point of the hydrated polymer media. Entrance 39 has a secondary entrance 39' for the introduction of "dry ice" for instances where dry ice is the preferred method of maintaining the subfreezing temperature. A cap may be placed over the entrance when an alternative cooling method as described hereinafter is employed.

In some instances, conventional mechanical refrigeration technology may be employed to maintain the internal temperature. In these situations, the extracted heat may be used in a heat exchanger 44 to preheat the hydration fluid used in the first module. In other situations a liquefied inert gas such as carbon dioxide, nitrogen, or a fluorocarbon may be used as the cooling agent. An appropriate set of nozzles as shown at 51 may inject the gas at 0 psig, dramatically lowering the temperature. As the gas heats and rises it may be drawn off into recovery plenum 52 by inlet fan on a compressor for recompression and recirculation. Again the heat extracted from the recirculatable gas can be used to heat the hydration fluid. In any case, it would be preferable to include a baffle system or air curtain system at entrance 39 and outlet 44 to minimize ingress or egress of gas at these areas. Inasmuch as dry ice may be retained on or other external solids accumulate on the media as is frozen, outlet 44 directs the frozen hydrated media to a second vibratory screen conveyor such that the particulate is removed. Provision may readily be made to recirculate this material to entrance 39'.

Figure 4:
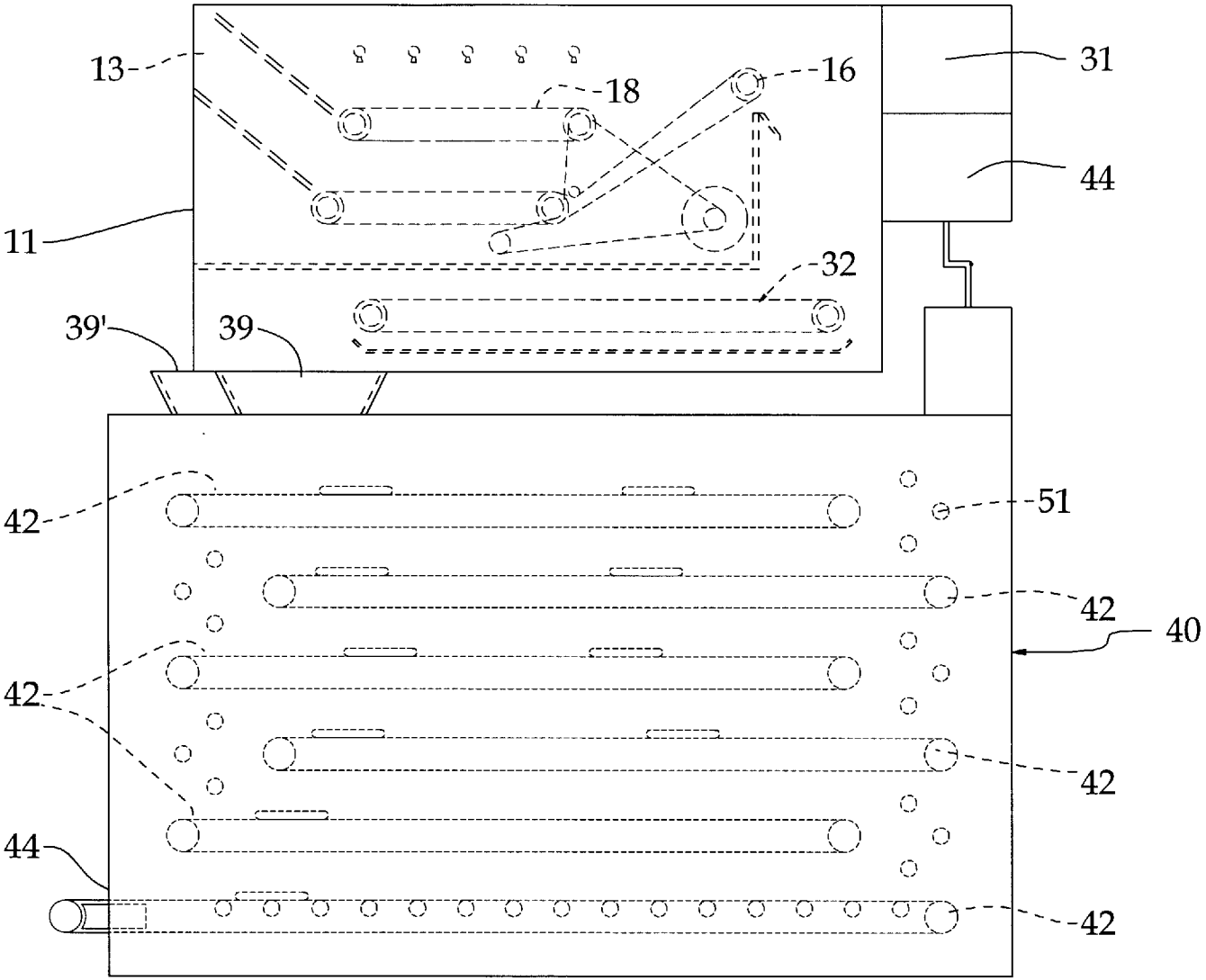

A system as described herein may occupy as little space as an area three feet wide and eight feet long, if the modules are stacked as shown in FIG. 4. The standing height would be less than eight feet tall. A machine of this size could process up to 1200 pound of hydration fluid per hour, which would be sufficient to fully hydrate two rolls of polymer laden web three hundred feet long and fifteen inches wide. This quantity of media would be sufficient to place a layer inside eighty cartons each having a two cubic foot capacity each hour; thus, making it ideal for small shipping operations where perishable or heat sensitive products are packaged for cold shipment.

What I claim is:

1. A modular refrigerant media preparation apparatus for hydrating and freezing a super-absorbent polymer captured in a web of flexible permeable material, comprising:

a. first module means for hydrating said polymer including means for urging said web through said first module; and, b. refrigerant module means for freezing hydrated polymer as said web is urged through said refrigerant module means.

2. Apparatus as defined in claim 1 wherein said first module means includes a conveyor for moving said web through a sufficient quantity of hydration fluid at a speed appropriate to achieve substantially complete hydration of said super-absorbent polymer.

3. Apparatus as defined in claim 2 wherein said conveyor submerges said web in a pool of said hydration fluid.

4. Apparatus as defined in claim 3 further comprising means for maintaining a quantity of said hydration fluid in said first module for substantially continuous hydration of super-absorbent polymer in a web passing through said first module.

5. Apparatus as defined in claim 2 further comprising means for adjusting the speed of said conveyor to increase or decrease the length of time said super-absorbent polymer is exposed to said hydration fluid.

6. Apparatus as defined in claim 2 further comprising means for spraying said hydration fluid onto said web and conveyor as said web moves through said first module.

7. Apparatus as defined in claim 1 wherein said refrigerant module includes a conveyor mounted therewithin for moving a hydrated web through said module at a speed appropriate to facilitate freezing of the hydration fluid within said web.

8. Apparatus as defined in claim 7 wherein said refrigerant module comprises a chamber for the introduction of an inert gas about said conveyor and said web conveyed thereby to maintain the interior of said chamber at a temperature beneath the freezing point of said hydrated web.

9. Apparatus as defined in claim 8 wherein said inert gas is selected from the group consisting of nitrogen, carbon dioxide, and inert halocarbons.

10. Apparatus as defined in claim 8, wherein said chamber has an entrance for receiving said hydrated web and an outlet for discharging said hydrated web after freezing, and including means for limiting the ingress and egress of gases through said entrance and outlet.

11. Apparatus as defined in claim 10 wherein said means for limiting comprises air curtains proximal said entrance and said outlet.

12. Apparatus as defined in claim 8 further comprising recirculation means for withdrawing a quantity of inert gas from said chamber, extracting heat from said quantity of inert gas, and providing said gas for reintroduction into said chamber.

13. Apparatus as defined in claim 12 comprising means for using heat extracted from said quantity of inert gas for heating said hydration fluid to predetermined temperature for use in said first module.

14. Apparatus as defined in claim 7 wherein said refrigeration unit includes mechanical means for maintaining the interior of said chamber at a temperature beneath the freezing point of said hydrated web.

15. Apparatus as defined in claim 14, wherein said chamber has an entrance for receiving said hydrated web and an outlet for discharging said hydrated web after freezing, and including means for limiting the ingress an egress of gases through said entrance and outlet.

16. Apparatus as defined in claim 15 wherein said means for limiting comprises air curtains proximal said entrance and said outlet.

17. Apparatus as defined in claim 1 further comprising shaker means operably positioned to a receive frozen hydrated web from said refrigerant module for dislodging external moisture and solids from said frozen hydrated web.

18. Apparatus as defined in claim 17 wherein said shaker means comprises an open conveyor for supporting and conveying said web thereon along a first direction and means for imparting vibrations to said web.

19. Apparatus as defined in claim 18 wherein said means for imparting comprises a frame supporting said open conveyor and at least one eccentric mass mounted on said frame for rotation such that at least said conveyor is moved in at least one direction transverse to said first direction.

20. A modular packaging preparation apparatus for hydrating and freezing a super-absorbent polymer captured in a web of flexible permeable material, comprising:

a. first module means for hydrating said polymer including means for urging said web through said first module including conveying means for moving said web through a sufficient quantity of hydration fluid at a speed appropriate to achieve substantially complete hydration of said super-absorbent polymer, means for maintaining a quantity of said hydration fluid in said first module for substantially continuous hydration of super-absorbent polymer in a web passing through said first module, means for adjusting the speed of said conveying means to increase or decrease the length of time said super-absorbent polymer is exposed to said hydration fluid; and, b. refrigerant module means for freezing hydrated polymer as said web is urged through said refrigerant module means including a chamber having an entrance for receiving said hydrated web and an outlet for discharging said hydrated web after freezing, and including means for limiting the ingress an egress of gases through said entrance and outlet, secondary conveying means mounted within said chamber for moving a hydrated web through said chamber at a speed appropriate to facilitate freezing of the hydration fluid within said web, means for maintaining the interior of said chamber at a temperature beneath the freezing point of said hydrated web.

21. Apparatus as defined in claim 20 further comprising shaker means operably positioned to a receive frozen hydrated web from said refrigerant module for dislodging external moisture and solids from said frozen hydrated web.

* * * * *